US006019400A

United States Patent [19]

Prevot et al.

[11] Patent Number: 6,019,400

[45] Date of Patent: Feb. 1, 2000

[54] LOCK FOR SLIDING CLOSURE

[75] Inventors: Gérard Prevot, Willerwald; Gérard Desplantes, Sarrebourg; Eric Alvarez, Hommert, all of France

[73] Assignee: Ferco International Ferrures Et Serrures De Batiment, Reding, France

[21] Appl. No.: 09/054,708

[22] Filed: Apr. 3, 1998

[30] Foreign Application Priority Data

Apr. 3, 1997 [FR] France ..... 97 04065

[51] Int. Cl.[7] ..... E05C 1/04

[52] U.S. Cl. ..... 292/145; 292/140; 292/DIG. 53

[58] Field of Search ..... 292/120, 128, 292/140, 162, 170, 175, DIG. 38, DIG. 53, DIG. 54, DIG. 55, 337, DIG. 46, DIG. 20, 165, 166, 173, 174, 139, 143, DIG. 30, DIG. 31, DIG. 49, DIG. 63

[56] References Cited

U.S. PATENT DOCUMENTS

| | | | |
|---|---|---|---|
| 2,768,852 | 10/1956 | Hicks | 292/337 |
| 3,469,875 | 9/1969 | Ahlgren | 292/175 |
| 3,671,065 | 6/1972 | Bingham | 292/175 |
| 3,850,464 | 11/1974 | Bisbing . | |
| 4,121,863 | 10/1978 | Lawrence | 292/175 |
| 4,302,037 | 11/1981 | Nunez | 292/DIG. 57 |
| 4,470,624 | 9/1984 | Bisbing . | |
| 4,480,862 | 11/1984 | Fleming | 292/DIG. 46 |
| 4,482,178 | 11/1984 | Damiana | 292/175 |
| 4,492,396 | 1/1985 | Luke et al. | 292/DIG. 38 |
| 4,676,081 | 6/1987 | Craig | 292/337 |
| 4,791,756 | 12/1988 | Simpson | 49/175 |
| 4,828,299 | 5/1989 | Poe | 292/139 |
| 5,139,291 | 8/1992 | Schultz | 292/42 |
| 5,145,221 | 9/1992 | Pennebaker et al. | 292/175 |
| 5,301,989 | 4/1994 | Dallman et al. | 292/142 |
| 5,618,067 | 4/1997 | Carlson et al. | 292/175 |
| 5,671,958 | 9/1997 | Szapucki et al. | 292/175 |

FOREIGN PATENT DOCUMENTS

| | | | |
|---|---|---|---|
| 0 044 264 | 1/1982 | European Pat. Off. . | |
| 2 700 577 | 7/1994 | France . | |
| 2 712 337 | 5/1995 | France . | |
| 28 26 082 | 7/1979 | Germany . | |
| WO 97/40247 | 10/1997 | WIPO | E05B 9/08 |

*Primary Examiner*—Teri Pham
*Attorney, Agent, or Firm*—Kenyon & Kenyon

[57] ABSTRACT

In a lock for sliding closures two fixing members are disposed at respective corresponding ends of the casing and inserted with the casing into a slot in the closure. A first fixing member has at least one part which retracts elastically in the longitudinal direction of the casing in the direction towards the center of the casing to enable it to pass through the slot in the closure and to return elastically in the opposite direction to engage the corresponding edge surface of the slot.

19 Claims, 3 Drawing Sheets

LOCK FOR SLIDING CLOSURE

BACKGROUND OF THE INVENTION

1. Field of the Invention

The present invention concerns a lock for sliding door, window or like closures.

2. Description of the Prior Art

A standard lock for sliding door, window or like closures comprises a casing inside which moves longitudinally a sliding assembly comprising a bolt-carrier and actuated by means of a maneuvering member and two fixing members adapted to be fitted at respective corresponding ends of the casing and to be inserted with the casing into a slot in the closure, each of said members having, for fixing said casing to the closure, means adapted to engage with the corresponding edge surface of the slot in the closure and with the inside edge of said edge surface, and means for engaging with the casing so as to press against the face of the closure in which the slot is formed a covering plate attached to the casing and adapted to cover said slot.

In the conventional way the fixing members include a re-entrant shoulder adapted to engage with the corresponding edge surface of the slot in the closure and are joined to the casing by a screw passing through the covering plate of the casing. To fit the casing into the slot in the closure the corresponding screw is unscrewed as far as possible to slacken off the fixing member to allow the latter to be inserted in the slot. The screw is then screwed fully home to clamp the edge of the slot in the closure between the covering plate of the casing and the re-entrant shoulder of the fixing member.

This embodiment, which is satisfactory in terms of utility, has the primarily esthetic disadvantage of requiring a screw passing through the covering plate and the head of which can therefore be seen on the visible face of the latter.

Further, the screw must be fully unscrewed before inserting the casing into the slot and then the screw must be screwed fully home to fix the casing and to prevent any movement of it in the longitudinal and transverse directions of said casing and in the direction perpendicular to the covering plate of the casing.

The aim of the present invention is to remedy the drawbacks of prior art embodiments and to propose a lock of the aforementioned type that is simple to use and reliable, allows very quick fitting of the lock to the slot in the closure and has no visible fixing member such as a screw on the visible face of the covering plate of the casing.

SUMMARY OF THE INVENTION

In a lock in accordance with the invention at least a first fixing member has at least one part adapted to retract elastically in the longitudinal direction of the casing in the direction towards the center of the casing to enable it to pass through the slot in the closure and to return elastically in the opposite direction to engage the corresponding edge surface of the slot.

Provided that at least part of a first fixing member is adapted to retract elastically in the longitudinal direction of the casing, the opposite end of the casing can be fitted to the corresponding end of the slot before pressure is applied to the covering plate of the casing in the direction towards the inside of the casing and of the closure: the part adapted to retract elastically then retracts to pass through the slot in the closure after which it returns elastically in the opposite direction to engage with the corresponding edge surface of the slot and fix the casing and the lock in said slot.

Other features and advantages of the invention will become apparent from the following detailed description given by way of non-limiting example only with reference to the appended drawings.

DETAILED DESCRIPTION OF THE PREFERRED EMBODIMENTS

Figure 1:
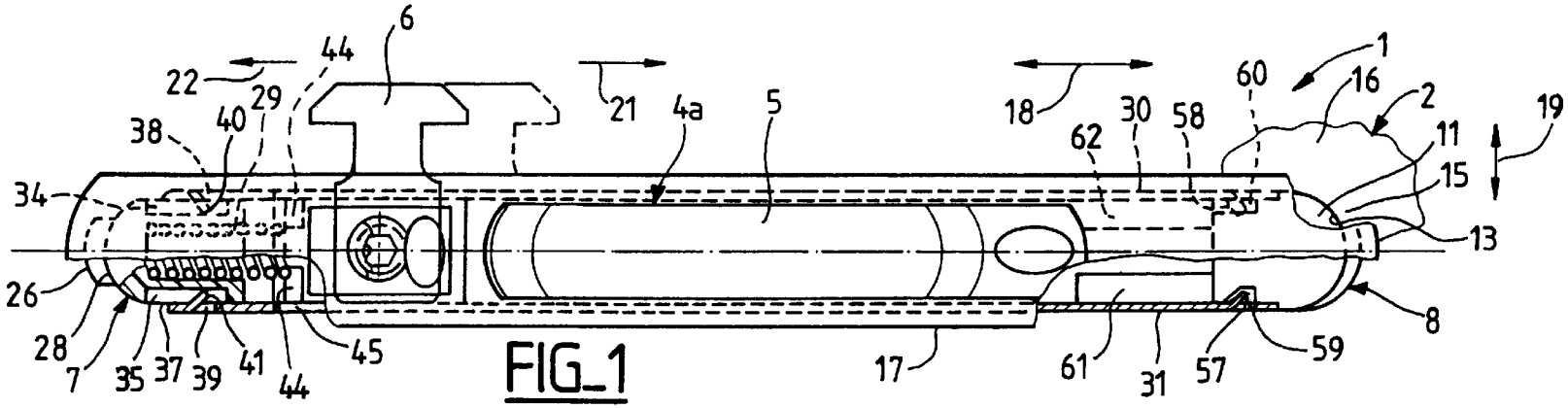
FIG. 1 is a cut away top view of a lock constituting a first embodiment of the present invention.
Figure 2:
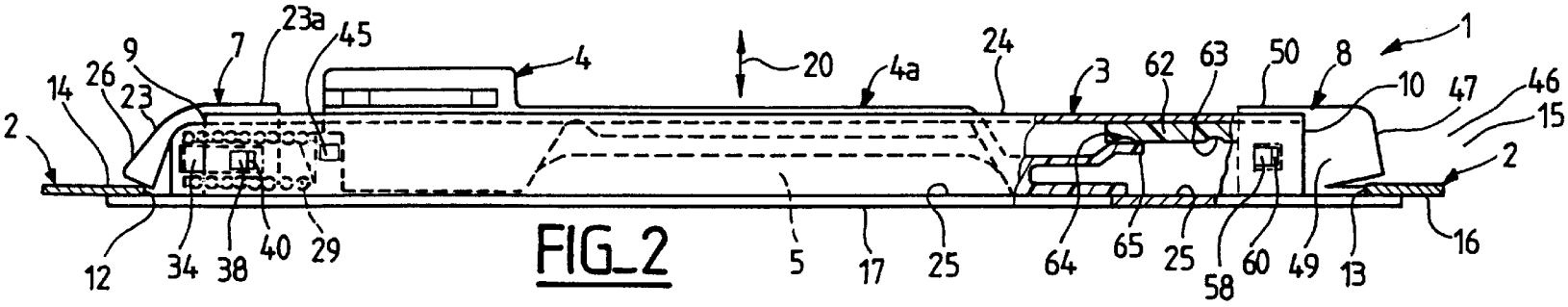
FIG. 2 is a cut away elevation view of the FIG. 1 embodiment.
Figure 3:
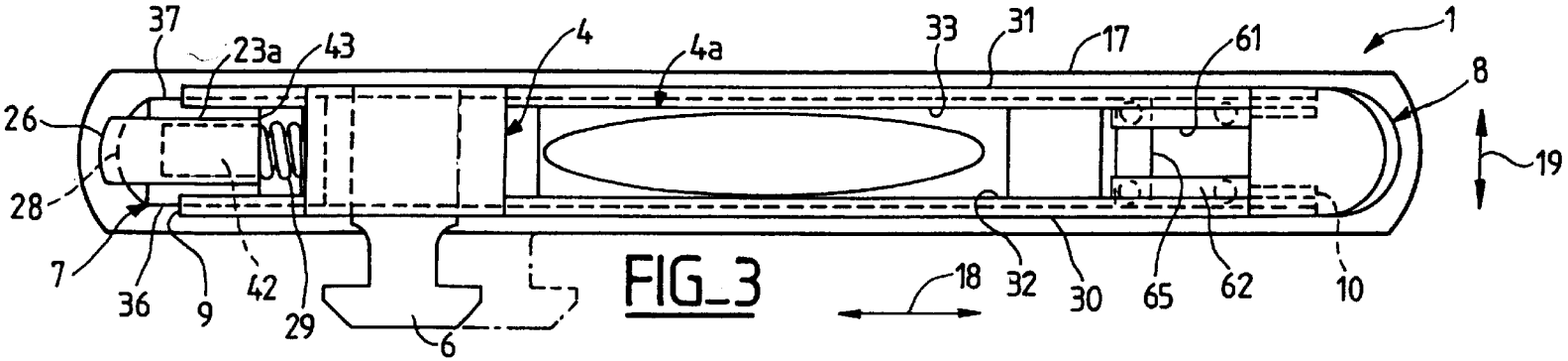
FIG. 3 is a bottom view of the FIG. 1 embodiment.

In the embodiment shown in FIGS. 1 through 3 the lock 1 for a sliding door, window or like closure 2 includes a casing 3 inside which moves longitudinally a sliding assembly 4*a* including a bolt-carrier 4 and actuated by means of a maneuvering member 5 serving as a handle.

The bolt-carrier 4 is of any type and carries a bolt 6 of any type. The handle 5 is also of any type.

The lock 1 also includes two fixing members 7, 8 adapted to be placed at a respective corresponding end 9, 10 of the casing 3 and to be inserted with the casing 3 into a slot 11 in the closure 2.

For fixing the casing 3 to the closure 2 each of the fixing members 7, 8 includes means adapted to engage with the corresponding edge surface 12, 13 of the slot 11 in the closure 2 and with the inside edge 14, 15 of said edge surface and means for engaging the casing 3 to press a covering plate 17 attached to the casing 3 and adapted to cover said slot 11 against the face 16 of the closure 2 including the slot 11.

The fixing members attach the casing 3 firmly to the face 16 of the closure 2 and prevent any movement of the casing 3 and the covering plate 17 in the longitudinal direction 18, in the transverse direction 19 or in the depthwise direction 20 of the casing 3 when the latter is in place in the slot 11 in the closure 2.

In accordance with the present invention the lock 1 is characterized in that a first fixing member 7 has one part at least adapted to retract elastically in the longitudinal direction 18 of the casing 3 in the direction 21 towards the center of the casing 3 to enable it to pass through the slot 11 in the closure 2 and to return elastically in the opposite direction 22 to engage with the corresponding edge surface 12 of the slot 11.

The part adapted to retract elastically includes a ramp 23 oriented so as to extend from the back 24 of the casing 3 towards the covering plate 17 of the latter and longitudinally in the direction 22 from the inside towards the outside of the casing 3 and adapted to bear on the edge surface 12 of the slot 11 to slide in the direction 21 towards the inside of the casing 3 when the lock 1 is pressed against the edges of the slot 11 in the closure 2.

As shown in detail in FIG. 2 in particular the ramp 23 terminates in the vicinity of the inside face 25 of the covering plate 17 in a part forming a projecting dihedron 26 extended by a second ramp 27 in the direction 21 from the outside towards the inside of the casing 3 and terminating in a re-entrant shoulder 28. The re-entrant shoulder 28 is adapted to engage the corresponding edge surface 12 of the slot 11 and the second ramp 27 is adapted to engage the inside edge 14 of said edge surface 12 upon elastic return movement of the ramp 23.

Figure 9:
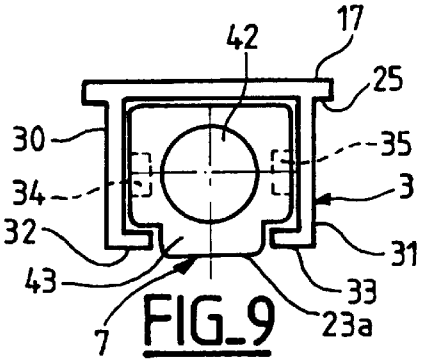
FIG. 9 is an end view of the member from FIGS. 7 and 8 as seen from the right in FIG. 8.
Figure 8:
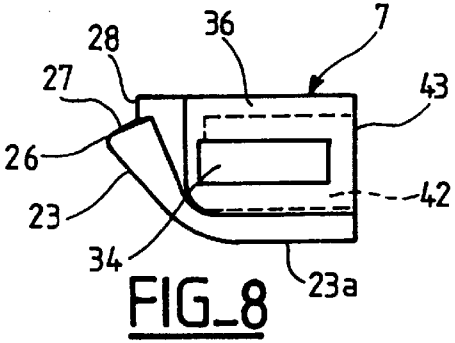
FIG. 8 is an elevation view of the member from FIG. 7.
Figure 7:
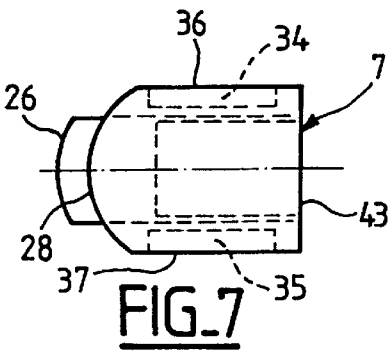
FIG. 7 is a top view of the mobile fixing member shown in FIG. 1.

In the embodiment shown generally in FIGS. 1 through 3 and in detail in FIGS. 7 through 9 the first fixing member 7 is mobile longitudinally inside the casing 3 against a spring 29 fitted inside the casing 3 in order to retract to enable insertion of the casing 3 into the slot 11 in the closure 2.

As shown diagrammatically in FIG. 9 the first fixing member 7 corresponds to a conventional implementation of the casing 3 in which each of the longitudinal lateral walls 30, 31 of the casing 3 has at its free end opposite the covering plate 17 a respective rim 32, 33 parallel to the covering plate 17 and directed towards the inside of the casing, the two rims 32, 33 constituting the back 24 of the casing 3 and merging if appropriate to form a solid back.

The body of the fixing member 7 therefore has a cross-section that substantially matches the cross-section of the internal cavity of the casing 3.

To facilitate guidance of the fixing member 7 as it moves in the longitudinal direction 18 of the casing 3 the body of the member 7 has a part 23*a* projecting outwardly between the rims 32 and 33 and which extends the ramp 23 in the example shown.

The first fixing member 7 includes means adapted to cooperate with complementary means of the casing 3 to allow at least partial insertion of the first fixing member 7 into the casing 3 and to prevent withdrawal of said member 7 after its insertion without impeding longitudinal sliding of said first fixing member 7 relative to the casing 3.

To this end the first fixing member 7 comprises two longitudinal grooves 34, 35 on its longitudinal lateral walls 36, 37. Depressions 38, 39 are formed in the longitudinal lateral walls 30, 31 of the casing 3 after inserting the first fixing member 7 to provide two tongues 40, 41 entering the respective grooves 34, 35.

As shown in FIGS. 1 to 3 the spring 29 has a longitudinal end which enters a recess 42 in the face 43 of the first fixing member 7 facing in the direction 21 towards the center of the casing 3 and its other longitudinal end abuts against at least one stop tongue 44 projecting transversely towards the inside of the casing 3 and consisting for example of a depression 45 on one of the longitudinal lateral walls 30, 31 of the casing 3.

At the end opposite the first fixing member 7 the lock 1 has a second fixing member 8 forming a fixed abutment and comprising:

means for engaging the corresponding edge surface 13 of the slot 11 and the inside edge 15 of said edge surface 13; these means comprise the projecting dihedron 46 similar to the projecting dihedron 26, the first ramp 47 similar to the first ramp 23, the second ramp 47*a* similar to the second ramp 27 and the re-entrant shoulder 48 similar to the shoulder 28;

means adapted to abut against the corresponding end wall 10 of the casing 3;

a central body 49 adapted to enter the casing 3; and means adapted to cooperate with complementary means of the casing 3 to allow insertion of the central body 49 into the casing 3 and to prevent withdrawal of the central body 49 after its insertion.

The central body 49 of the second fixing member 8 is attached to an outside body 50 wider and higher than the central body 49 and therefore providing on respective opposite sides of said central body 49 two L-shape shoulders 51, 52 respectively adapted to abut against the edge surfaces of the longitudinal lateral wall 30, 31 and of the corresponding rim 32, 33 of the casing 3.

For fixing the second fixing member 8 to the casing 3 after inserting the central body 49 the central body 49 has on at least one of its longitudinal lateral faces 53, 54 a groove 55, 56 adapted to receive a tongue 57, 58 projecting transversely towards the inside of the casing 3 and consisting for example of a depression 59, 60 formed on the corresponding longitudinal lateral wall 30, 31 of the casing 3 after insertion of the central body 49 into said casing 3.

In the example shown the central body 49 is extended in the direction away from the outside body 50 by at least one arm 61, 62 extending longitudinally along the corresponding rim 32, 33 forming the back 24 of the casing 3. Each arm 61, 62 has on its face facing the covering plate 17 two shaped ports 63 at a predetermined distance from each other and each adapted to receive a complementary shaped portion 64 of a lug 65 on the bolt-carrier 4 pressing elastically on said face and attached to the bolt-carrier 4 so as to materialize stable unlocked and locked positions of the bolt-carrier 4 inside the casing 3.

In this example the shaped portions 63 of the arms 61, 62 are concave recesses. The lug 65 of the bolt-carrier 4 extends substantially the whole transverse inside width of the casing 3 and has two convex shaped portions 64 in the form of excrescences adapted to enter one or other of the recesses 63.

The converse arrangement with convex shaped portions on the arms 61, 62 and concave shaped portions on the lug 65 could be used.

Figure 4:
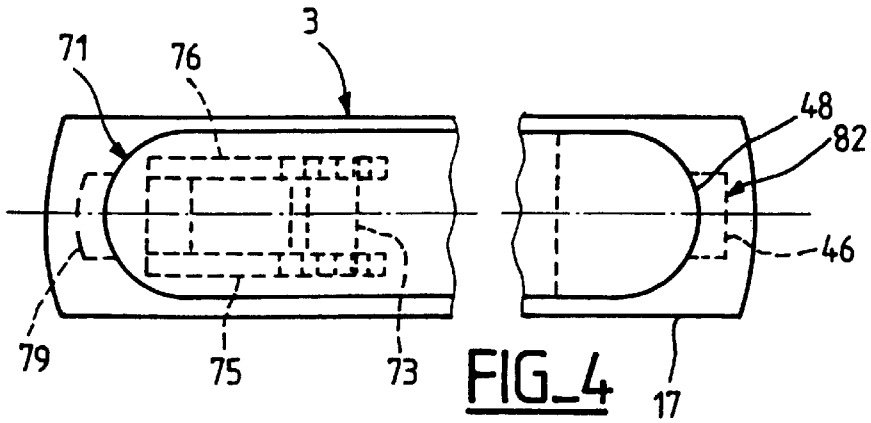
FIG. 4 is a fragmentary view similar to FIG. 1 of another embodiment of the invention.
Figure 5:
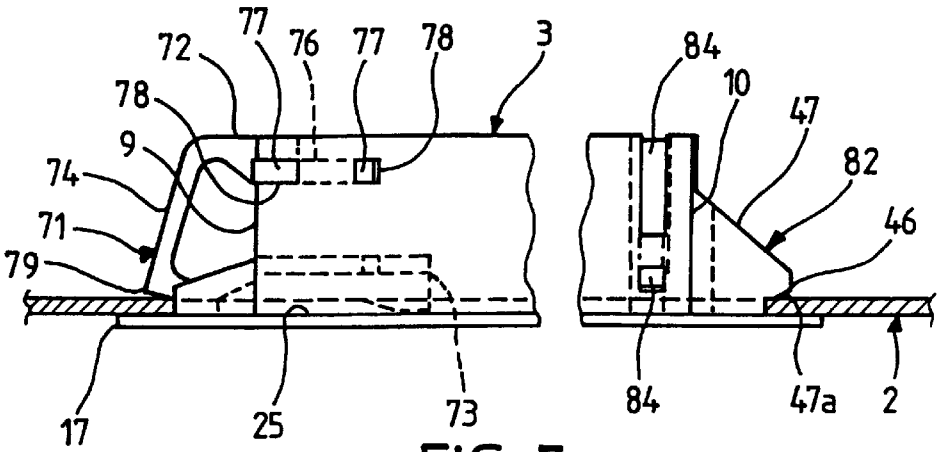
FIG. 5 is a fragmentary view similar to FIG. 2 of the FIG. 4 embodiment.
Figure 6:
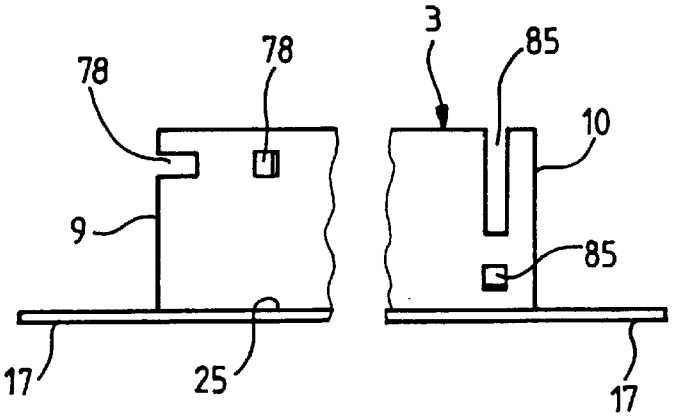
FIG. 6 is a view similar to FIG. 5 showing the casing without the fixing members.
Figure 12:
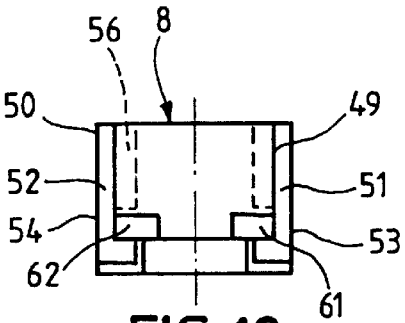
FIG. 12 is an end view of the member from FIGS. 10 and 11 as seen from the right in FIG. 11.
Figure 11:
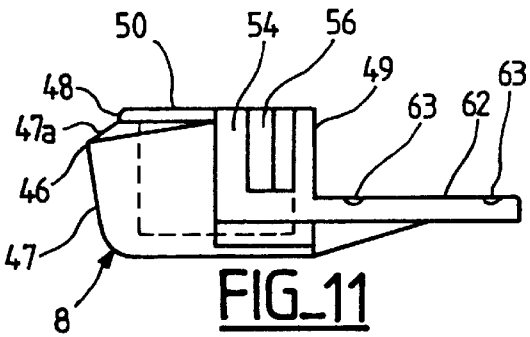
FIG. 11 is an elevation view of the member from FIG. 10.
Figure 10:
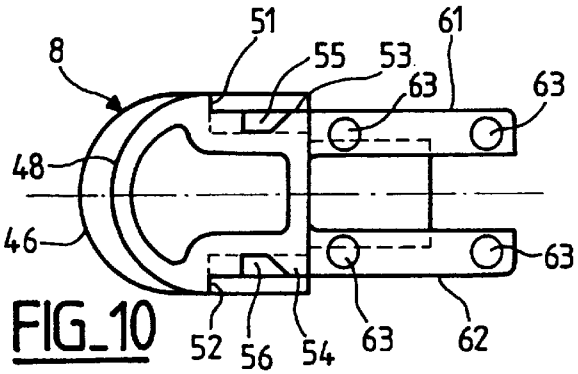
FIG. 10 is a top view of the fixed fixing member from the FIG. 1 embodiment.
Figure 14:
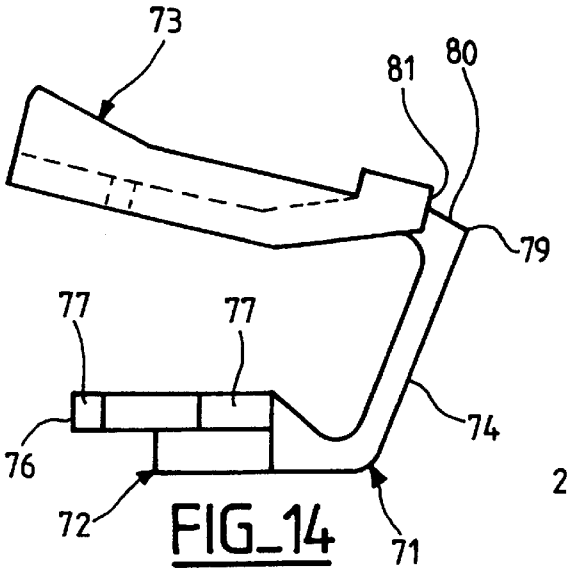
FIG. 14 is an elevation view of the member from FIG. 13.
Figure 13:
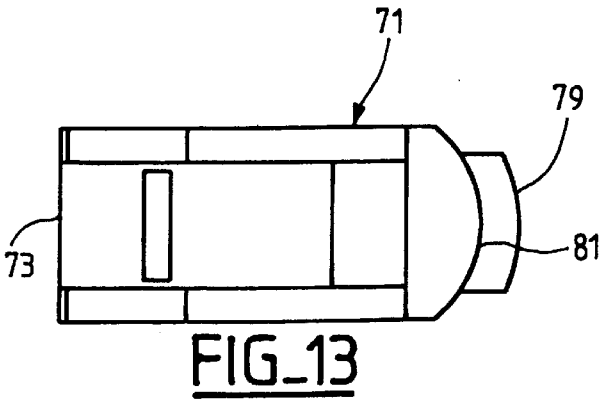
FIG. 13 is a top view of the elastic fixing member shown in FIGS. 4 and 5.

In the embodiment shown in FIGS. 4 and 5 and in detail in FIGS. 13 and 14 the first fixing member 71 is a single part, substantially U-shaped and having two branches 72, 73 connected by a core forming a ramp 74.

The two branches 72, 73 of the U-shape can move elastically towards each other. A first branch 72 is adapted to bear on the rims 32, 33 constituting the back 24 of the casing 3. The second branch 73 is adapted to bear on the inside face 25 of the covering plate 17 of the casing 3.

The first branch 72 includes means for engaging the casing 3.

The first branch 72 includes arms 75, 76 extending longitudinally and adapted to be moved elastically towards each other so that they can be inserted longitudinally into the casing 3. Each arm 75, 76 has on its face adjacent the corresponding longitudinal lateral wall 30, 31 of the casing 3 at least one member 77 projecting transversely towards the outside of the casing 3 adapted to clip into a corresponding orifice 78 in the lateral wall 30, 31 of the casing 3.

As shown in FIG. 5 the ramp 74 has substantially the same inclination as the ramp 23 of the member 7 when the member 71 is introduced into the casing 3.

When the casing 3 to which the member 71 is clipped is pressed against the edges of the slot 11 the ramp 74 bears on the corresponding edge surface 12 and retracts and this presses the branch 73 towards the inside of the casing.

Like the ramp 23, the ramp 74 has a projecting dihedron 79 which is extended by a second ramp 80 and a re-entrant shoulder 81.

When the projecting dihedron 79 has moved inwardly beyond the edge surface 12 the elastic expansion of the member 71 moves the ramp 74 elastically towards the outside of the casing. The edge surface 12 slides along the second ramp 80 and engages the re-entrant shoulder 81.

The second fixing member 82 shown in FIGS. 4 and 5 provide a fixed abutment.

The member 82 is comparable to the member 8 described with reference to FIGS. 1 through 3 and 10 through 12 except for the arms 61 and 62. It includes a projecting dihedron 46, a ramp 47, a re-entrant shoulder 48 and a second ramp 47*a*.

The central body 83 of the member 82 is fixed to the casing 3 by members 84 projecting transversely towards the outside of the casing which clip into complementary orifices 85 in the longitudinal lateral walls 30, 31 of the casing 3.

Of course, the present invention is not limited to the embodiments just described and many changes and modifications can be made to the latter without departing from the field of the invention, in particular by combining the various modes of immobilizing the fixed and mobile fixing members described, by depressed tongues cooperating with grooves of said members, or by projecting members of the fixing members clipping into corresponding orifices of the casing, or by any like means, or by combining in any way the fixing members described and shown.

The two tongues 36 and 37 project transversely towards the inside of the casing 3 and consist for example of two depressions 38, 39.

What is claimed is:

1. A lock for a sliding closure, the lock comprising:

an elongated casing including first and second parallel lateral walls projecting from a face of and integral with a covering plate, said casing being adapted to be introduced through an elongate slot of an inside wall of a stile of the sliding closure, with said covering plate covering the slot, and a sliding assembly slidable inside said casing between said lateral walls in a longitudinal direction of said casing and including a bolt carrier carrying a bolt, the lock further comprising a maneuvering member for actuating said sliding assembly from the inside wall of the stile, and first and second fixing members separate from said casing and adapted to be fitted at respective corresponding ends of said casing and adapted to be inserted with said casing into the slot in the closure, each of said fixing members having, for fixing said casing to the closure, first engaging means adapted to engage with a corresponding edge surface of the slot in the closure inside wall and with an inside edge of the edge surface and second engaging means for engaging with said casing, said first and second engaging means adapted to press said covering plate against the inside wall of the closure when in a respective engaged position, wherein at least one of said first and second fixing members has at least one part adapted to move elastically in said longitudinal direction of said casing in a direction towards a center of said casing while slidingly resting along an internal face of said covering plate to enable said at least one of said first and second fixing members to pass through the slot in the closure inside wall and to return elastically in an opposite direction to engage the corresponding edge surface of the slot and the inside edge of the edge surface.

2. The lock of claim 1 wherein said at least one part includes a ramp oriented to extend from a back of said casing towards said covering plate and longitudinally in a direction from said center of said casing towards an end of said casing and adapted to bear on the corresponding edge surface of the slot to slide in said direction towards said center of said casing when the lock is pressed against opposed edges of the slot in the closure.

3. The lock of claim 2 wherein said ramp terminates near said internal face of said covering plate in a part forming a projecting dihedron extended by a second ramp directed in a direction from said end of said casing towards said center of said casing terminating in a re-entrant shoulder, said re-entrant shoulder being adapted to engage the corresponding edge surface of the slot and said second ramp being adapted to engage the inside edge of the edge surface upon elastic return movement of said ramp.

4. The lock of claim 1 wherein said at least one of said first and second members is formed in one substantially U-shaped piece and has first and second branches extending longitudinally connected by a core forming a ramp, said two branches being moveable elastically towards each other, said first branch being adapted to bear on a back of said casing and said second branch being adapted to bear on said internal face of said covering plate.

5. The lock of claim 4 wherein said first branch includes means for engaging said casing.

6. The lock of claim 5 wherein said first branch includes arms extending longitudinally and adapted to be moved towards each other elastically so that they can be inserted longitudinally into said casing, each arm having on a face adjacent a corresponding lateral wall of said casing at least one member projecting transversely towards an outside of said casing adapted to clip into an orifice in said corresponding lateral wall of said casing.

7. The lock of claim 1 wherein said at least one of said first and second fixing members is mobile longitudinally inside said casing against a spring mounted inside said casing which is retractable for allowing insertion of said casing into the slot in the closure.

8. The lock of claim 7 wherein said at least one of said first and second fixing members includes first fastening means adapted to cooperate with complementary second fastening means of said casing to allow at least partial insertion of said at least one of said first and second fixing members into said casing and to prevent withdrawal of said at least one of said first and second fixing members after its insertion without impeding longitudinal sliding of said at least one of said first and second fixing members relative to said casing.

9. The lock of claim 8 wherein said first fastening means includes first and second longitudinal grooves in first and second longitudinal lateral walls, respectively, of said at least one of said first and second fixing members, and wherein said second fastening means includes first and second tongues projecting transversely towards an inside of said casing, said first and second longitudinal grooves adapted to receive within them said first and second tongues, respectively.

10. The lock of claim 9 wherein said first and second tongues consist of depressions formed in said first and second lateral walls of said casing, respectively, after insertion of said at least one of said first and second fixing members into said casing.

11. The lock of claim 7 wherein said spring has a first longitudinal end that enters a recess in a face of said at least one of said first and second fixing members facing in said direction towards said center of said casing and a second longitudinal end that abuts at least one stop tongue projecting transversely towards an inside of said casing.

12. The lock of claim 11 wherein said at least one stop tongue consists of a depression on one of said lateral walls of said casing.

13. The lock of claim 1 wherein the other of said first and second fixing members forms a fixed abutment and includes:

means for engaging the corresponding edge surface of the slot and the inside edge of the edge surface;

abutting means adapted to abut against a corresponding end wall of said casing;

a central body adapted to enter said casing; and first fastening means adapted to cooperate with complementary second fastening means of said casing to allow said central body to be inserted into said casing and to prevent withdrawal of said central body after its insertion.

14. The lock of claim 13 wherein said central body includes first and second longitudinal lateral faces and has on at least one of said first and second longitudinal lateral faces a groove adapted to receive a tongue projecting laterally towards an inside of said casing.

15. The lock of claim 14 wherein said tongue consists of a depression formed on one of said lateral walls of said casing after insertion of said central body into said casing.

16. The lock of claim 13 wherein said central body is extended by at least one arm extending longitudinally along a back of said casing and said at least one arm having on a face facing towards said covering plate two shaped portions at a predetermined distance from each other and each shaped portion adapted to receive a complementary shaped portion of a lug included on said bolt-carrier bearing elastically on said face so as to materialize stable an unlocked position and a locked position of said bolt-carrier inside said casing.

17. The lock according to claim 1 wherein said at least one of said first and second fixing members includes a body adapted to be inserted longitudinally into said casing.

18. The lock according to claim 17 wherein said body includes back bearing means adapted to bear against a back of said casing and inside bearing means adapted to bear on said internal face of said covering plate.

19. The lock according to claim 18 wherein each of said first and second lateral walls of said casing has at a free edge opposite said covering plate a respective rim parallel to said covering plate and extending towards an inside of said casing, said two rims constituting said back of said casing.

* * * * *